US008671698B2

(12) United States Patent
Wang

(10) Patent No.: US 8,671,698 B2
(45) Date of Patent: Mar. 18, 2014

(54) GAS LIQUIFIER

(75) Inventor: Chao Wang, Manlius, NY (US)

(73) Assignee: Cryomech, Inc., Syracuse, NY (US)

( * ) Notice: Subject to any disclaimer, the term of this patent is extended or adjusted under 35 U.S.C. 154(b) by 1257 days.

(21) Appl. No.: 11/869,810

(22) Filed: Oct. 10, 2007

(65) Prior Publication Data

US 2009/0094992 A1 Apr. 16, 2009

(51) Int. Cl.

| | |
|---|---|
| ***F25B 9/00*** | (2006.01) |
| ***F25B 19/00*** | (2006.01) |
| ***F17C 3/08*** | (2006.01) |
| ***F17C 3/10*** | (2006.01) |
| ***F25J 1/00*** | (2006.01) |

(52) U.S. Cl.
USPC ..... 62/6; 62/600; 62/608; 62/51.1; 62/47.1; 62/48.2

(58) Field of Classification Search
USPC ..... 62/611, 6, 45.1, 47.1, 48.2, 51.1
See application file for complete search history.

(56) References Cited

U.S. PATENT DOCUMENTS

| | | | | |
|---|---|---|---|---|
| 4,754,249 | A * | 6/1988 | Yamamoto et al. | 335/216 |
| 5,065,582 | A * | 11/1991 | Seifert | 62/45.1 |
| 5,163,297 | A | 11/1992 | Yani et al. | |
| 5,265,430 | A * | 11/1993 | Chen et al. | 62/48.1 |
| 5,339,650 | A * | 8/1994 | Hakamada et al. | 62/51.1 |
| 5,381,666 | A * | 1/1995 | Saho et al. | 62/47.1 |
| 5,583,472 | A * | 12/1996 | Moritsu et al. | 335/216 |
| 5,765,377 | A * | 6/1998 | Kim | 62/6 |
| 5,791,149 | A * | 8/1998 | Dean | 62/6 |
| 6,212,904 | B1 * | 4/2001 | Arkharov et al. | 62/615 |
| 6,389,821 | B2 * | 5/2002 | Strobel et al. | 62/47.1 |
| 6,490,871 | B1 * | 12/2002 | Stautner | 62/51.1 |
| 7,131,276 | B2 | 11/2006 | Pan et al. | |
| 2003/0230089 | A1 * | 12/2003 | Strobel | 62/51.1 |
| 2004/0112065 | A1 * | 6/2004 | Pan et al. | 62/6 |
| 2004/0144101 | A1 * | 7/2004 | Hofmann | 62/6 |
| 2004/0194473 | A1 * | 10/2004 | Daniels | 62/6 |
| 2005/0044860 | A1 * | 3/2005 | Mita et al. | 62/6 |
| 2005/0204751 | A1 * | 9/2005 | White et al. | 62/51.1 |
| 2006/0086101 | A1 * | 4/2006 | Miki | 62/48.2 |
| 2006/0174635 | A1 * | 8/2006 | Xu et al. | 62/6 |
| 2007/0022761 | A1 * | 2/2007 | Schlenga et al. | 62/51.1 |
| 2007/0089432 | A1 * | 4/2007 | Boesel et al. | 62/51.1 |
| 2007/0107446 | A1 * | 5/2007 | Schlenga et al. | 62/51.1 |

FOREIGN PATENT DOCUMENTS

JP 62277707 A * 12/1987

OTHER PUBLICATIONS

Wang. "Helium Liquefaction With a 4K Pulse Tube Cryocooler." Cryogenics 41 (2001), 491-496.
Wang. "Intermediate Cooling From Pulse Tube and Regenerator in a 4K Pulse Tube Cryocooler." Cryogenics 48 (2008), 154-159.
Wang. "Extracting Cooling From the Pulse Tube and Regenerator in a 4 K Pulse Tube Cryocooler." Cryocoolers 15 (2009), 177-184.

* cited by examiner

*Primary Examiner* — Mohammad M Ali
*Assistant Examiner* — Keith Raymond
(74) *Attorney, Agent, or Firm* — Brown & Michaels, PC

(57) ABSTRACT

A cryocooler for liquefying gas in which the neck of the dewar or cryostat includes a cold end of a cryocooler with the first stage cooling station, the first stage regenerator, the second stage cooling station, the second stage regenerator, and a condenser thermally coupled to the second cooling station. Radiation baffles are also present within the neck portion of the dewar between the storage portion for the dewar and the condenser, such that when the cryocooler is turned off, the radiation baffles reduce heat radiation on the cryogen in the storage section of the dewar.

4 Claims, 10 Drawing Sheets

GAS LIQUIFIER

BACKGROUND OF THE INVENTION

1. Field of the Invention

The invention pertains to the field of gas liquefaction with a pulse tube cryocooler. More particularly, the invention pertains to liquefaction of gas by locating the cold head of a cryocooler within the neck of a dewar or cryostat.

2. Description of Related Art

While many laboratories and industries have applications which require liquid helium, at the present time the most widely used liquid helium producing system, such as the Collins type liquefier, is larger than most sites need to operate their experiments. Some small-scale helium liquefiers have been developed using a combined Gifford-McMahon and Joule-Thomson cycle refrigerator. The systems are complicated, unreliable and costly.

Currently many helium dewars and helium cryostats for superconducting devices and low temperature physics in the field are not cryo-refrigerated and, thus, have an undesirably high liquid helium boil-off rate. The world's helium supply is finite and irreplaceable. Growing demand for helium worldwide increases pressure on costs and supply in recent years and in the near future. One of the promising solutions is recovery and recycling of helium by using a small helium liquefaction system.

Pulse tube cryocoolers, which do not use a mechanical displacer, are a known alternative to the Stirling and Gifford-McMahon cryocoolers. A pulse tube is essentially an adiabatic space wherein the temperature of the working fluid is stratified, such that one end of the tube is warmer than the other. A pulse tube refrigerator operates by cyclically compressing and expanding a working fluid in conjunction with its movement through heat exchangers. Heat is removed from the system upon the expansion of the working fluid in the gas phase. These result in high reliability, long lifetime and low vibration when compared to Stirling and GM cryocoolers.

Pulse tube cryocoolers with a cooling temperature below 4.2 K (liquid helium temperature) have been used for recondensing helium in MRI, NMR, SQUIDS et. al. low temperature superconducting devices.

In a prior art gas liquefaction using a two stage pulse tube cryocooler, as shown in prior art FIG. 1, the cold head 5 is connected to a compressor through lines 4.

As in other prior art liquifiers with pulse tube cryocoolers, the cold head 5 of the cryocooler resides in a vacuum chamber 31. The cold head 5 includes a first stage cooling station 13 and a second stage cooling station 11. The first stage cooling station 13 has a first stage temperature which is higher than a second stage temperature of the second stage cooling station 11. A compressor 34 is connected to the cold head 5 through lines 4. Spiral pre-cooling tubes 33 are thermally anchored onto the second stage regenerator 17 and a condenser 9 with fins 9*a* is thermally mounted on the second stage cooling station 11. Heat from the first stage cooling station 13 is removed by the first pulse tube 16, and the first stage regenerator 14. Heat from the second stage cooling station 11 is removed by the second pulse tube 12 and the second stage regenerator 17

The liquefaction circuit includes the gas transfer tube 32, connected to the gas inlet line 3, the pre-cooling heat exchanger 7 on the first stage cooling station 13, the spiral pre-cooling tubes 33 on the second stage regenerator 17, the condenser 9, and the liquid container 30. Gas from the inlet line 3 moves to the gas transfer tube 32 and is cooled first by the first stage pre-cooling heat exchanger 7 of the first stage cooling station 13 and then moves to through pre-cooling spiral tubes 33 on the second stage regenerator 17. The heat from the incoming gas can transfer to the second stage regenerator 17 through the regenerator tube wall as the gas passes through the pre-cooling spiral tubes 33.

From the end of the spiral tubes 33, the cooled vapor or gas moves to the condenser 9 where it is condensed. The condensed liquid drips from the fins of the condenser 9 into the liquid container. The gas to be liquefied is sealed within the liquefaction circuit or otherwise constrained to the tubing. The liquefaction circuit is surrounded by a vacuum chamber 31.

U.S. Pat. No. 7,131,276 discloses a pulse tube cryorefrigerator in which fins are present on the second stage regenerator. The fins may be an array of annular discs about the straight regenerator tube, a spiral tape affixed to the regenerator tube, spikes about the regenerator tube, plates, or accordion bellows. Additionally, the regenerator may be corrugated with creases arranged parallel with the axis of the tube and the annular fins only cover a portion of the length of the tube. Alternatively, the fins may also be used on the first stage regenerator.

SUMMARY OF THE INVENTION

A cryocooler for liquefying gas in which the neck of the dewar or cryostat or cryostat includes a cold end of a cryocooler with the first stage cooling station, the first stage regenerator, the second stage cooling station, the second stage regenerator, and a condenser thermally coupled to the second cooling station. Radiation baffles are also present within the neck portion of the dewar or cryostat between the storage portion for the dewar or cryostat and the condenser, such that when the cryocooler is turned off, the radiation baffles reduce heat radiation on the cryogen in the storage section of the dewar or cryostat.

The tubes of the first stage regenerator and the first stage pulse tube, as well as the second stage regenerator and pulse tube may have pre-cooling fins or pre-cooling spiral tubing thermally coupled thereon.

DETAILED DESCRIPTION OF THE INVENTION

Figure 2:
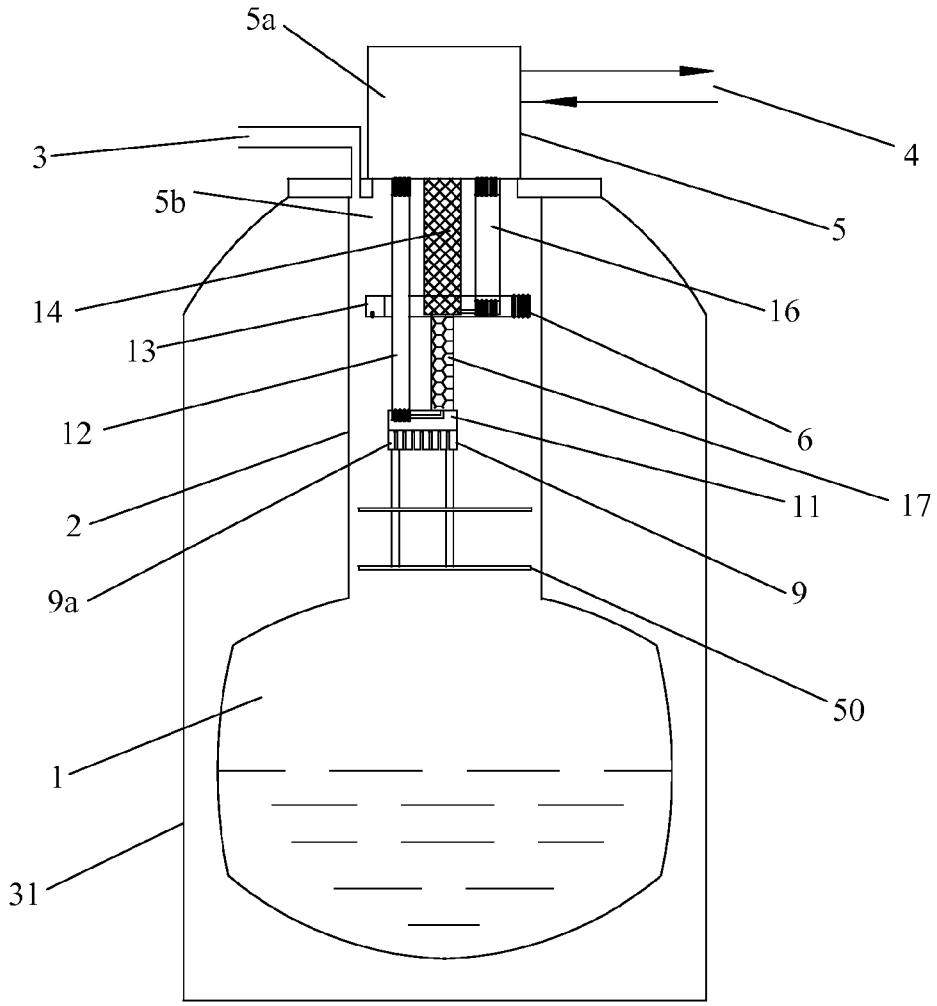
FIG. 2 shows a schematic of gas liquefaction with a pulse tube cryocooler of a first embodiment in which radiation baffles are mounted to the condenser.

FIG. 2 shows helium liquefaction inside a dewar using a two stage pulse tube cryocooler of a first embodiment of the present invention. The dewar or cryostat includes a neck 2, storage portion 1 and vacuum chamber 31. In present invention, the neck 2 of the dewar or cryostat extends up from the top end of the storage portion 1 containing cryogen, preferably helium to the room temperature end of the dewar or cryostat, upon which the cold head 5 sits. The neck 2 and the storage portion 1 are surrounded by a vacuum chamber 31. The cold head 5 has a hot end 5*a* outside of the neck 2 of the dewar or cryostat and a cold end 5*b* within the neck 2 of the dewar or cryostat.

The cold head 5 includes a first stage cooling station 13 and a second stage cooling station 11. The first stage cooling station 13 has a first stage temperature which is higher than the second stage temperature of the second stage cooling station 11. The first stage cooling station 13 includes pre-cooling heat exchanger 6. The second stage cooling station 11 is mounted to a condenser 9 with fins 9*a*.

Heat from the first stage cooling station 13 is removed by the first pulse tube 16 and the first stage regenerator 14. Heat from the second stage cooling station 11 is removed by the second pulse tube 12 and the second stage regenerator 17.

One or more radiation baffles 50 are present within the neck 2 of the dewar or cryostat below the condenser 9 mounted to the second stage cooling station 11 through rods or tubes with low thermal conductivity. A compressor 34 is connected to the cold head 5 through high and low pressure lines 4 for powering the cold head 5. Helium gas is introduced into the neck 2 adjacent the cold head 5 from a gas inlet line 3.

In the present invention, gas from the inlet line 3 moves into the neck 2 of the dewar or cryostat and is first pre-cooled by the tubes of the first stage regenerator 14, the first stage pulse tube 16, and the pre-cooling heat exchanger 6 on the first stage cooling station. After that, the gas is further cooled by the tubes of the second stage regenerator 17 and second stage pulse tube 12. The gas finally condenses into liquid on the fins 9*a* of the condenser 9. From the fins 9*a* of the condenser 9 liquid drips onto the radiation baffles 50. From the radiation baffles 50, the liquid flows to the storage portion 1 of the dewar or cryostat. The liquid may flow through the baffles 50 if they are perforated or around the baffles if they are solid. The radiation baffles 50 below the condenser 9 reduce the radiation heat to the liquid in the dewar or cryostat when the cryocooler is off.

Figure 3:
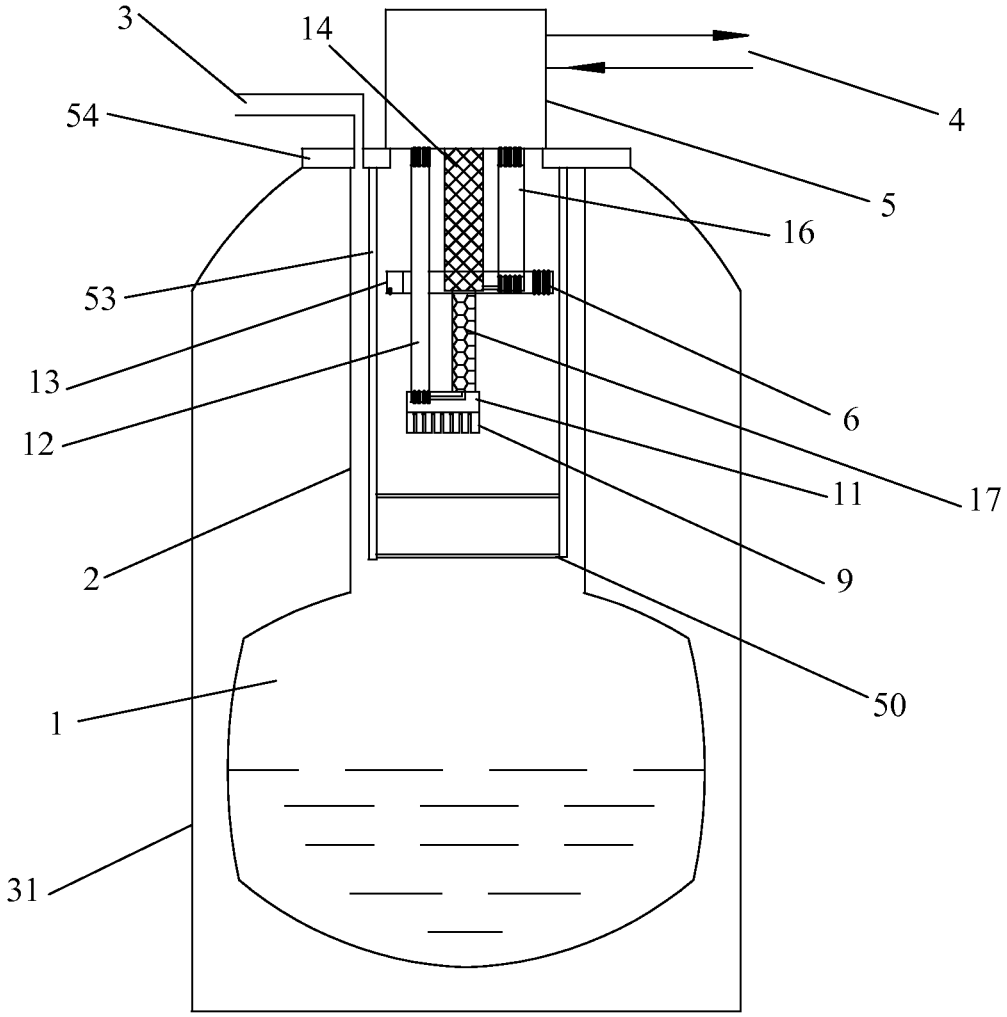
FIG. 3 shows a schematic of gas liquefaction with a pulse tube cryocooler of a second embodiment in which radiation baffles are mounted to a room temperature flange.
Figure 4:
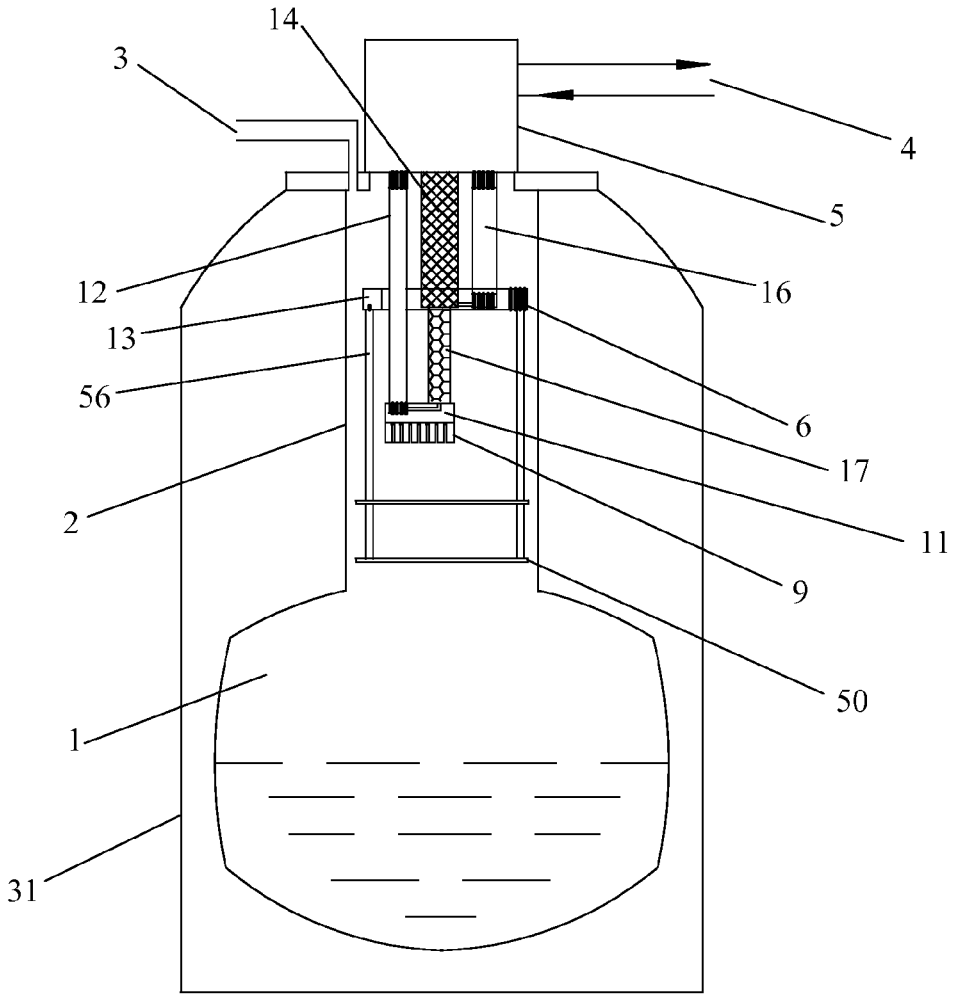
FIG. 4 shows a schematic of gas liquefaction with a pulse tube cryocooler of a third embodiment in which radiation baffles are mounted on the first stage cooling station.

The radiation baffles 50 below the condenser 9 may be secured in various ways within the neck 2 of the dewar or cryostat. As shown in FIG. 3, the radiation baffles 50 are secured or mounted to a room temperature flange 54 between the hot end 5*a* of the cold head 5 and the neck 2 of the dewar or cryostat in a second embodiment. Additionally, the radiation baffles 50 may be mounted to the first stage cooling station 13 as shown in FIG. 4 in a third embodiment.

Figure 1:
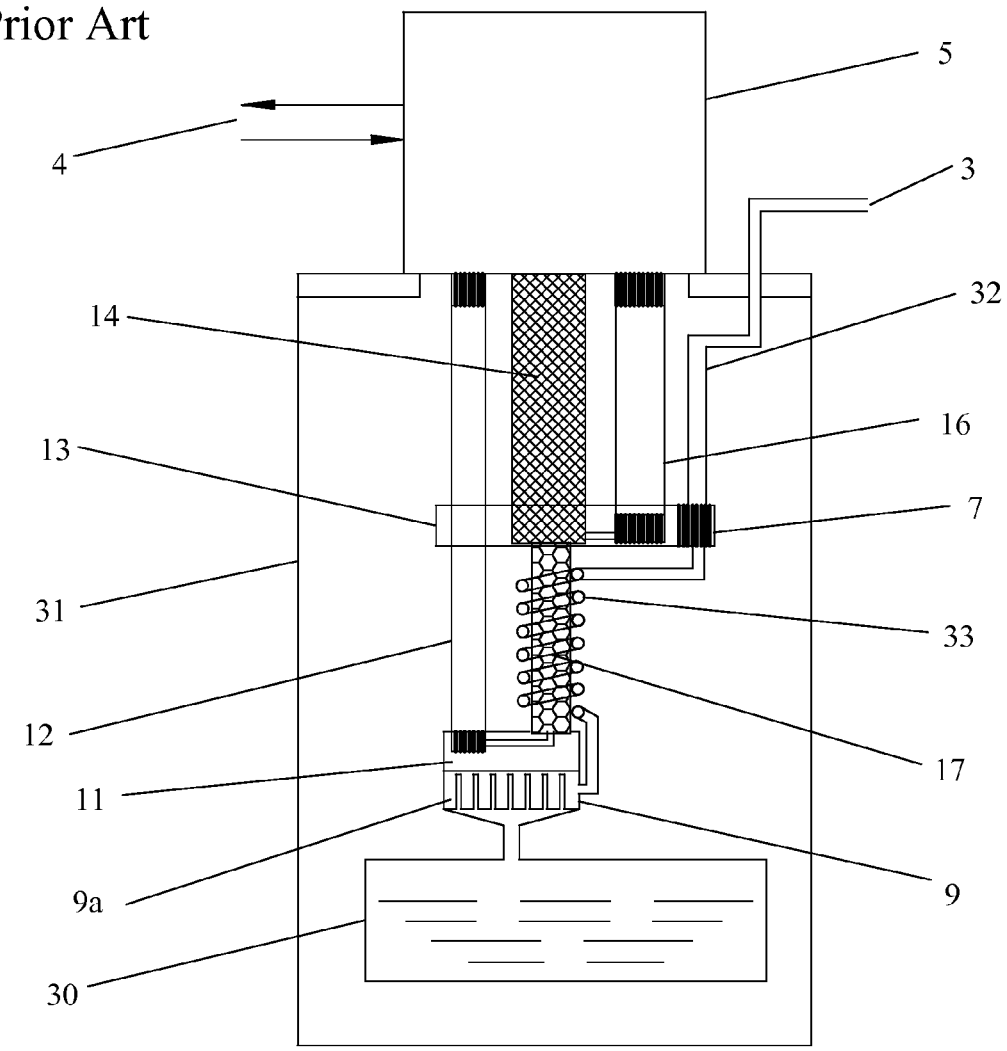
Fig. 1 Prior Art
FIG. 1 shows a prior art figure of prior art gas liquefaction with a pulse tube cryocooler.
Figure 5:
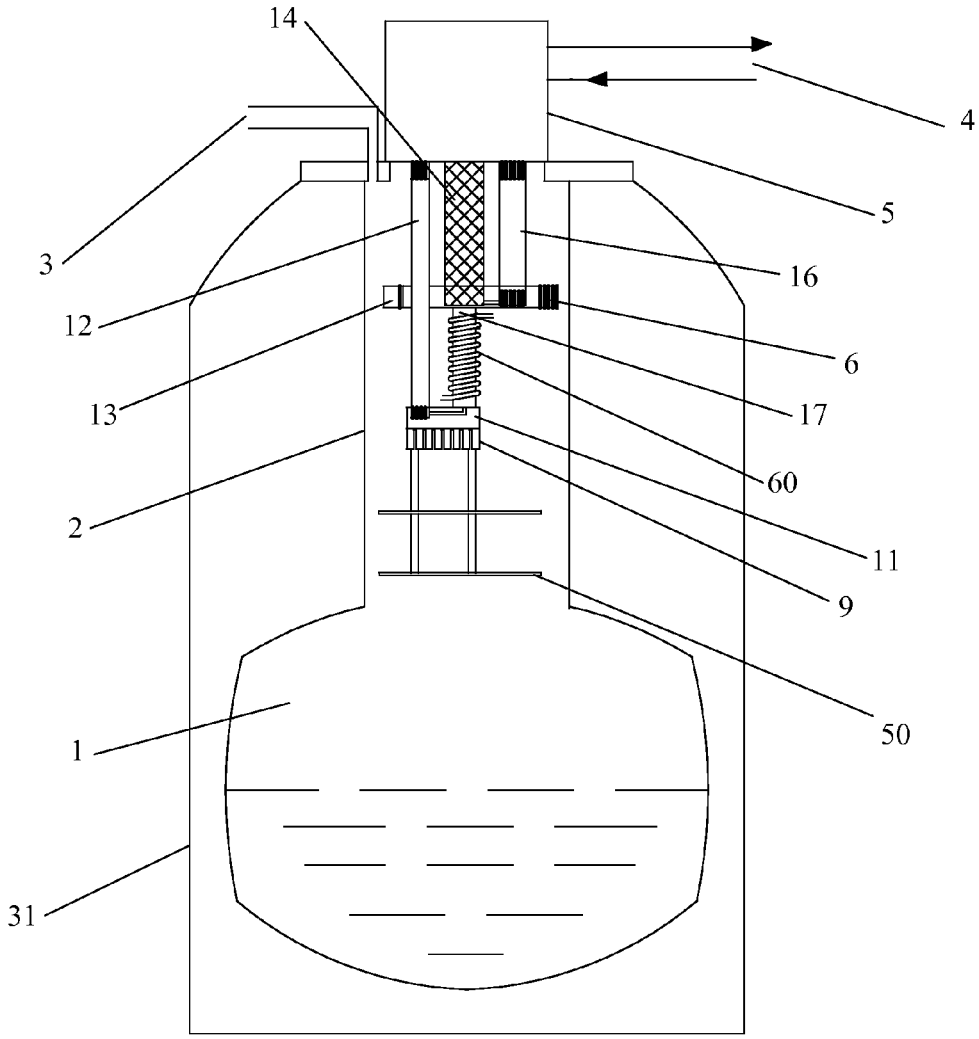
FIG. 5 shows a schematic of gas liquefaction with a pulse tube cryocooler of a fourth embodiment in which spiral tubes are thermally mounted to the second stage regenerator.

FIG. 5 shows a fourth embodiment of the present invention. In this embodiment, pre-cooling spiral tubing 60 is thermally mounted to the second stage regenerator 17. The pre-cooling spiral tubing 60 provides additional surface for pre-cooling of the gas. The spiral tube 60 is open at each end. This is different from the pre-cooling spiral tubes in prior art FIG. 1, in which the gas is restrict to flow only in the tubing. In the present invention, gas can be precooled by flowing inside the tubing 60 and also by the outside surface of the spiral tubing 60 driven by natural convection.

Figure 6:
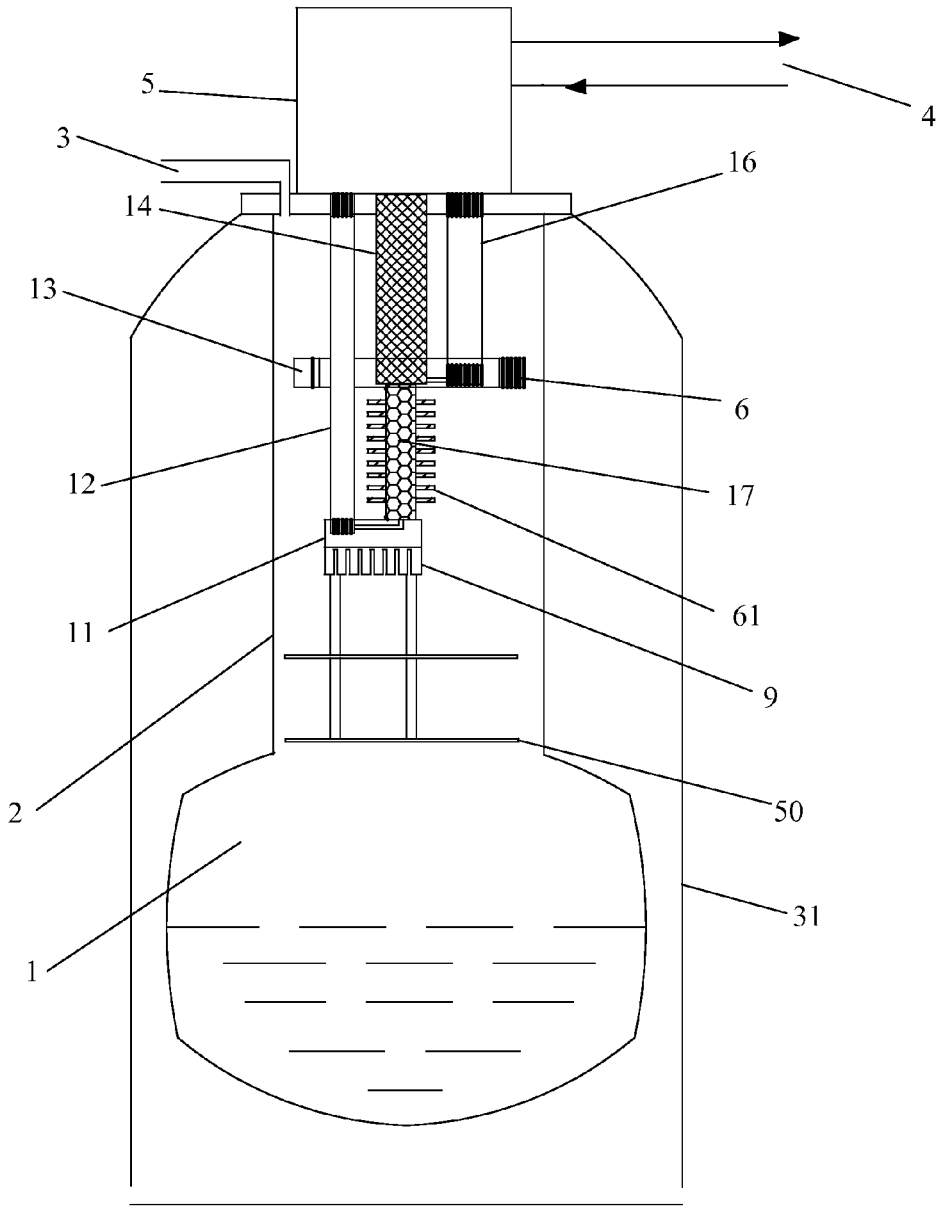
FIG. 6 shows a schematic of gas liquefaction with a pulse tube cryocooler of a fifth embodiment in which pre-cooling fins are thermally mounted to the second stage regenerator.

FIG. 6 shows a fifth embodiment of the present invention. In this embodiment, pre-cooling fins 61 are thermally mounted to the second stage regenerator 17. In the present invention, the gas is not restricted to a specific pathway of tubing, instead the gas flows over the tubes of regenerators and pulse tubes as well as the cooling stations within the neck 2 of the dewar or cryostat. The pre-cooling fins 61 provide additional surfacing for cooling of the gas. Since the pre-cooling fins 61 are not part of a specific gas path as in the prior art, the pre-cooling fins 61 cool the gas by natural convection. The fins 61 may be perforated plates, solid plates, brush fins, or other similar designs.

Figure 7:
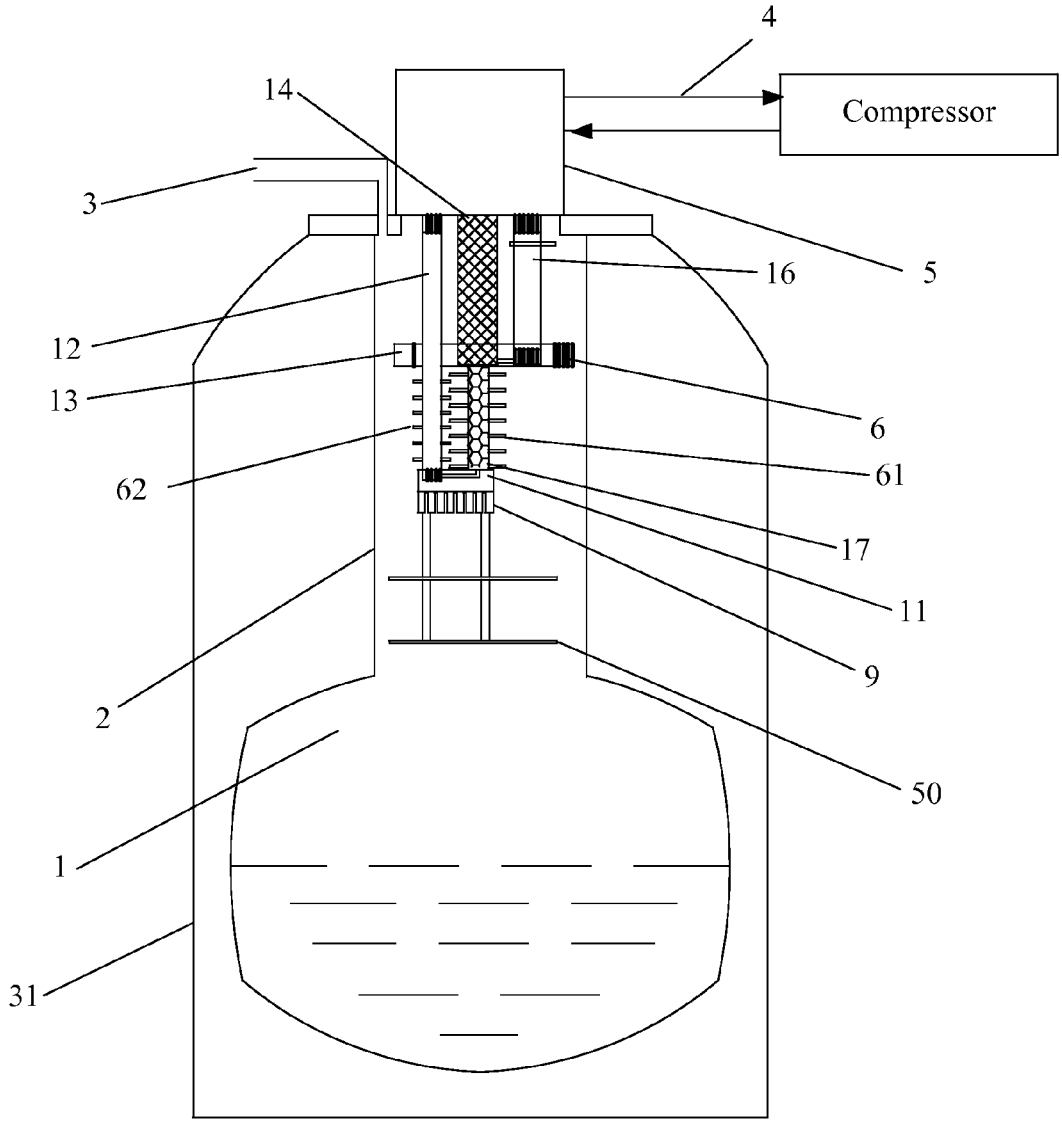
FIG. 7 shows a schematic of gas liquefaction with a pulse tube cryocooler of a sixth embodiment in which pre-cooling fins are thermally mounted to the second stage regenerator and pulse tube.

FIG. 7 shows a sixth embodiment of the present invention. In this embodiment, pre-cooling fins 61, 62 are thermally mounted to the second stage regenerator 17 and the second stage pulse tube 12. The pre-cooling fins 61, 62 on both regenerator 17 and pulse tube 12 provides additional surfacing for cooling of the gas. Therefore, these fins provide efficient pre-cooling for the gas.

Figure 8:
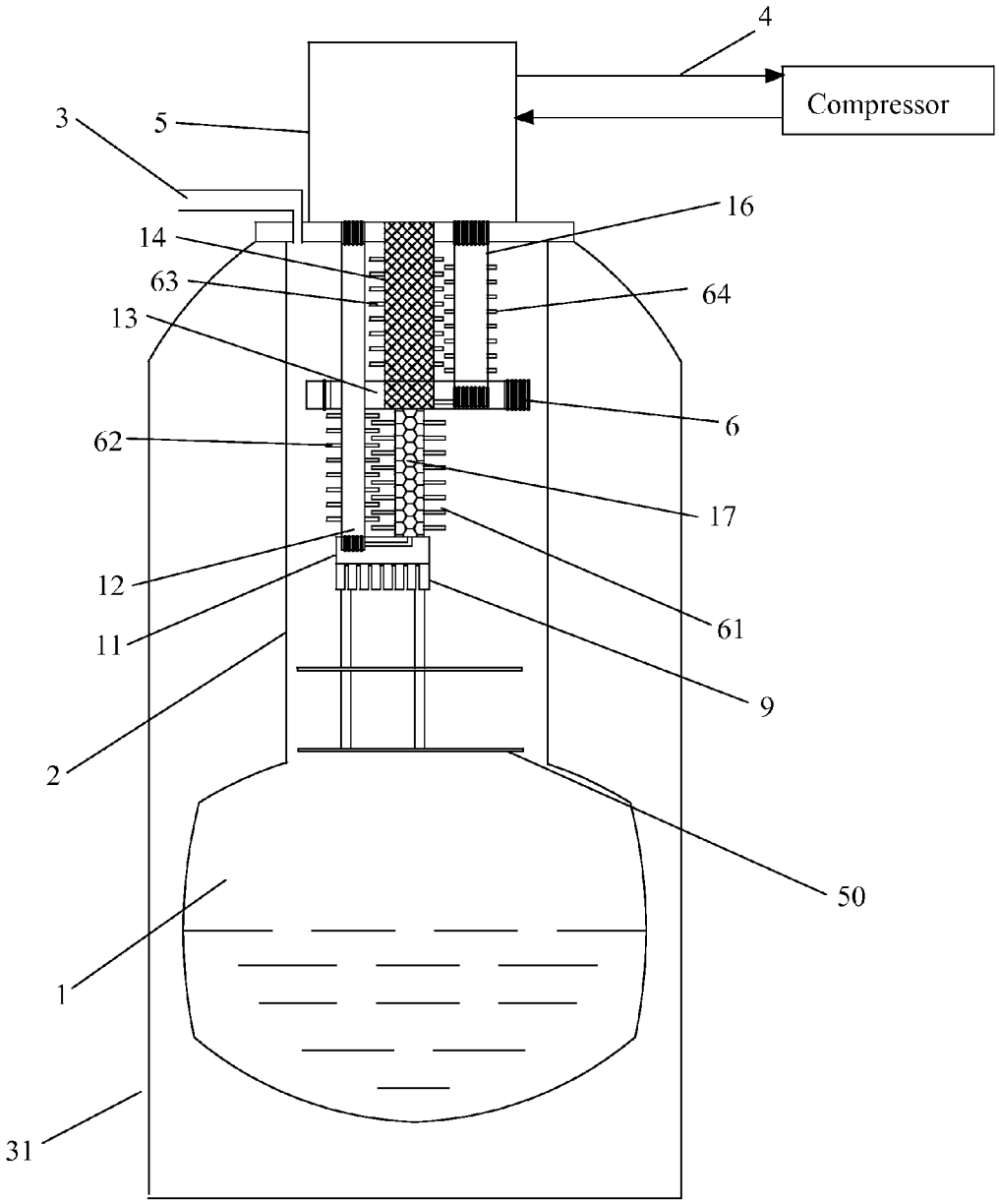
FIG. 8 shows a schematic of gas liquefaction with a pulse tube cryocooler of a seventh embodiment in which pre-cooling fins are thermally mounted to the first stage regenerator and pulse tube as well as the second stage regenerator and pulse tube.

FIG. 8 shows a seventh embodiment of the present invention. In this embodiment, pre-cooling fins 61, 62 are thermally mounted to the second stage regenerator 17 and pulse tube 12. Pre-cooling fins 63 and 64 are thermally mounted to the first stage regenerator 14 and pulse tube 16. The pre-cooling fins 63 and 64 enhance the pre-cooling for the gas between the room flange of the cold head and the first stage cooling station 13.

Figure 9:
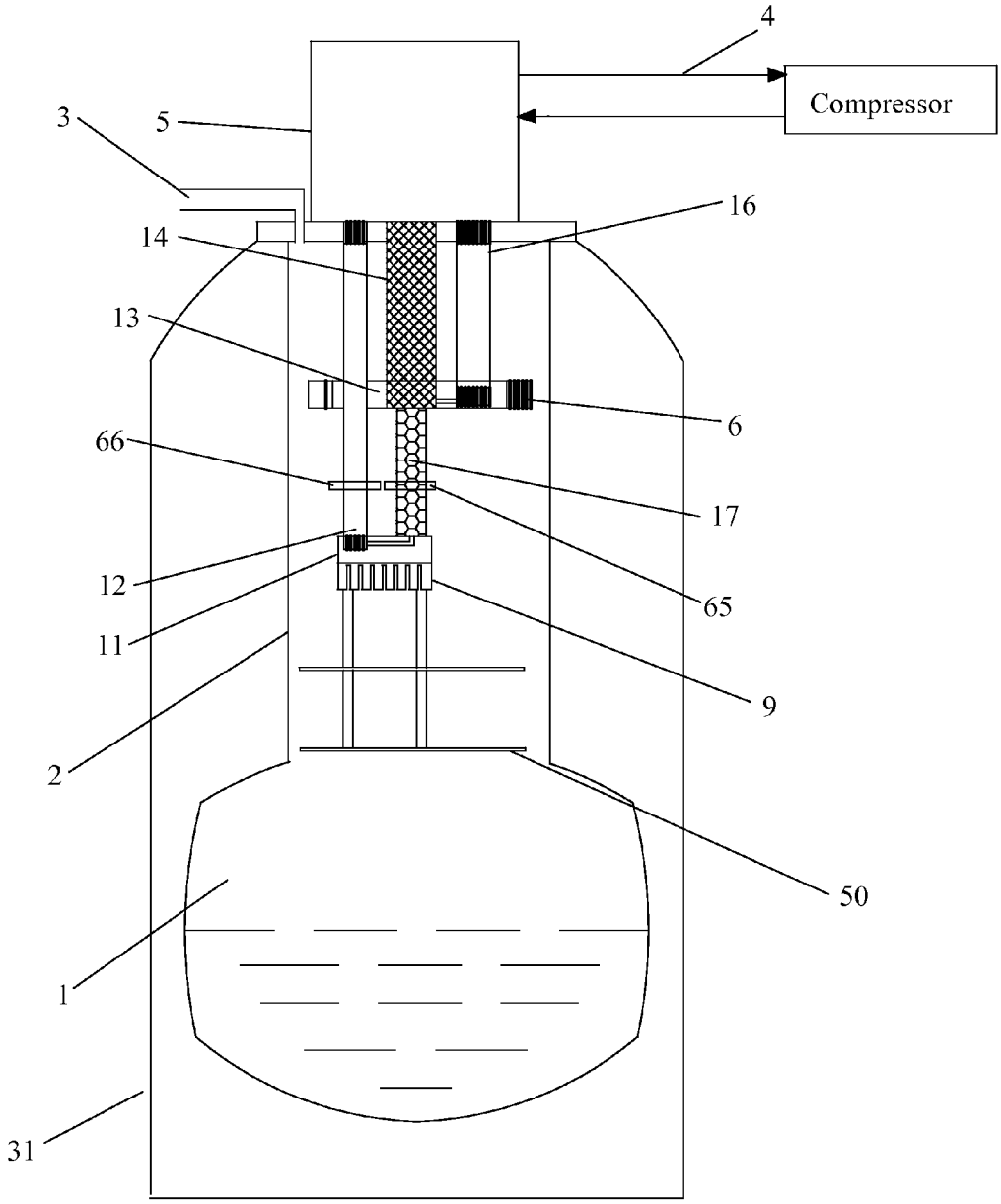
FIG. 9 shows a schematic of gas liquefaction with a pulse tube cryocooler of an eighth embodiment in which pre-cooling heat exchangers are thermally mounted to the second stage regenerator and pulse tube.

Alternatively, as shown in FIG. 9, the eighth embodiment, pre-cooling heat exchangers 65, 66 may be thermally mounted to the second stage regenerator 17 and the second stage pulse tube 12. The pre-cooling heat exchangers 65, 66 can have a thickness of 2 mm to 30 mm to make a large contact surface area between the heat exchangers 65, 66 and the regenerator 17 and pulse tube 12. The heat exchangers provide efficient pre-cooling of the gas. The fins may be perforated plates, solid plates, brush fins, or other similar designs.

Figure 10:
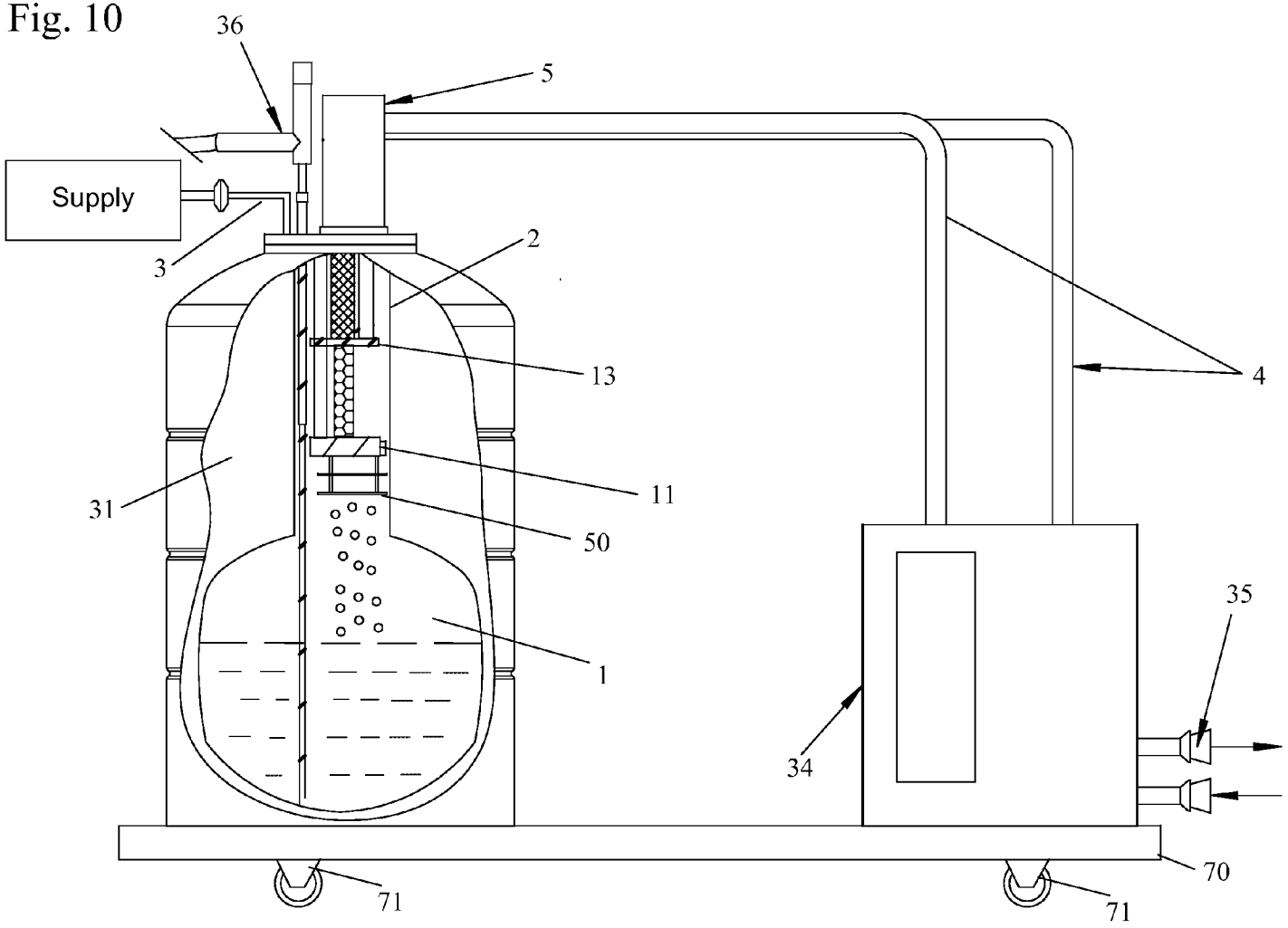
FIG. 10 shows a portable liquid gas plant system.

FIG. 10 shows a schematic of a portable liquid helium plant system. In the system, the neck 2 of the cryostat or dewar 1 extends up from the storage portion 1*a* of the dewar or cryostat to and surrounds a portion of the cold head 5. The neck 2 and the dewar or cryostat 1 itself are surrounded by a vacuum chamber 31. The cold head 5 has a hot end 5*a* outside of the neck 2 of the dewar or cryostat 1 and a cold end 5*b* within the neck 2 of the dewar or cryostat 1. The cold head 5 includes a first cooling station 13 and a second stage cooling station 11. The first stage cooling station 13 has a first stage temperature which is higher than the second stage temperature of the second stage cooling station 11. The first stage cooling station 13 includes pre-cooling fins 6. The second stage cooling station 11 is mounted to a condenser 9 with fins 9*a*. Heat from the first stage cooling station 13 is removed by the first pulse tube 16 and the first stage regenerator 14. Heat from the second stage cooling station 11 is removed by the second pulse tube 12 and the second stage regenerator 17.

Radiation baffles 50 are present within the neck 2 of the dewar or cryostat 1 below the condenser 9, mounted to the second stage cooling station 11. The radiation baffles 50 below the condenser 9 reduce the radiation heat on the liquid in the dewar or cryostat 1 when the cryocooler is off. From the radiation baffles 50, liquid flows to the dewar or cryostat 1. The liquid may flow through the baffles 50 if they are perforated or around the baffles if they are solid. The radiation baffles 50 below the condenser 9 may be secured in numerous ways as shown in FIGS. 2 through 4. A compressor 34 is connected to the cold head 5 through high and low pressure lines 4 for powering the cold head 5. A temperature sensor 36 may be present within the neck 2 of the dewar or cryostat 1 of the cryocooler to monitor changes in the temperature of the cryogen in the cryostat or dewar 1. A compressed gas, for example helium gas, is introduced into the cold head 5 from a gas inlet line 3.

For ease of movement, and to make the plant system more portable, a dolly 70 having appropriate wheels 71 supports the dewar 1 and compressor 34.

It will be understood that where the term "dewar" (for "dewar flask") or cryostat is used herein, the term is intended to mean not just a particular type of dewar flask or vacuum-insulated container, but also to include any insulated vessel for storage of liquefied gases at very low temperatures (cryogens).

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A portable cryogen liquefaction plant system comprising:

a dewar comprising a vacuum chamber, a storage portion within the vacuum chamber for containing cryogen, and a neck portion;

a cryocooler cold head comprising a hot end and a cold end, the cold end of the cold head received by the neck portion of the cryostat having a first stage cooling station, a first stage pulse tube, a first stage regenerator, a second stage cooling station, a second stage pulse tube, a second stage regenerator, and a condenser thermally coupled to the second cooling station; and a pre-cooling heat exchanger mounted upon and thermally coupled to the second stage pulse tube, the heat exchanger comprising a plurality of fins;

radiation baffles mounted to the cold head within the neck portion of the dewar below the condenser, such that when the cryocooler is turned off, the radiation baffles reduce heat radiation losses to the cryogen in the storage portion of the dewar;

a compressor coupled to the cryocooler cold head, for providing compressed gas to power the cold head; and a gas inlet line providing cryogen to a top of the neck of the dewar;

cryogen from the gas inlet line flowing over the cold head of the cryocooler and being pre-cooled without being confined to a pathway of tubing, the pre-cooling fins on the second stage pulse tube cooling the cryogen by natural convection.

2. The liquefaction plant system of claim 1, further comprising a wheeled dolly supporting the dewar and compressor.

3. A liquifier for liquefying gas comprising:

a dewar comprising a vacuum chamber, a storage portion within the vacuum chamber for containing cryogen, and a neck portion;

a gas inlet line providing cryogen to a top of the neck of the dewar;

a pulse-tube cryocooler cold head comprising a hot end and a cold end, the cold end of the cold head received by the neck portion of the cryostat having a first stage cooling station, a first stage regenerator, a second stage cooling station, a second stage regenerator, and a condenser thermally coupled to the second cooling station; and a spiral tube surrounding and in thermal contact with the second stage regenerator, the spiral tube having open upper and lower ends inside the neck of the dewar and in communication with gas surrounding the second stage regenerator, with neither the upper end nor the lower end of the spiral tube being connected to the gas inlet line.

4. The liquefier of claim 3, further comprising radiation baffles mounted to the cold head within the neck portion of the dewar below the condenser, such that when the cryocooler is turned off, the radiation baffles reduce heat radiation losses to the cryogen in the storage section of the dewar.

* * * * *